US009447607B2

(12) United States Patent
Malinen

(10) Patent No.: US 9,447,607 B2
(45) Date of Patent: Sep. 20, 2016

(54) DISC TUMBLER CYLINDER LOCK AND KEY COMBINATION

(71) Applicant: Abloy Oy, Joensuu (FI)

(72) Inventor: Perttu Malinen, Joensuu (FI)

(73) Assignee: ABLOY OY, Joensuu (FI)

( * ) Notice: Subject to any disclaimer, the term of this patent is extended or adjusted under 35 U.S.C. 154(b) by 0 days.

(21) Appl. No.: 14/440,719

(22) PCT Filed: Jul. 4, 2013

(86) PCT No.: PCT/FI2013/050733

§ 371 (c)(1),
(2) Date: May 5, 2015

(87) PCT Pub. No.: WO2014/072570

PCT Pub. Date: May 14, 2014

(65) Prior Publication Data

US 2015/0300044 A1 Oct. 22, 2015

(30) Foreign Application Priority Data

Nov. 7, 2012 (FI) ..... 20126160

(51) Int. Cl.

| | |
|---|---|
| ***E05B 27/00*** | (2006.01) |
| ***E05B 29/00*** | (2006.01) |
| ***E05B 21/06*** | (2006.01) |
| ***E05B 19/00*** | (2006.01) |

(52) U.S. Cl.

CPC ..... *E05B 29/0013* (2013.01); *E05B 19/0023* (2013.01); *E05B 21/066* (2013.01); *E05B29/0066* (2013.01); *E05B 27/00* (2013.01); *E05B 27/005* (2013.01); *E05B 27/0017* (2013.01); *E05B 27/0021* (2013.01); *E05B 27/0082* (2013.01); *E05B 29/00* (2013.01); *E05B 29/004* (2013.01); *E05B 29/0053* (2013.01)

(58) Field of Classification Search

CPC ..... E05B 29/0013; E05B 29/0066; E05B 29/004; E05B 29/00; E05B 29/0053; E05B 27/0082; E05B 27/005; E05B 27/0017; E05B 27/0021; E05B 27/0078; E05B 27/00; E05B 19/0023

USPC ..... 70/336, 409, 344, 359, 348, 347, 350, 70/356, 357, 490, 496, 367, 372

See application file for complete search history.

(56) References Cited

U.S. PATENT DOCUMENTS

| | | | | |
|---|---|---|---|---|
| 4,686,843 | A * | 8/1987 | Martikainen | E05B 21/066 70/366 |
| 5,490,405 | A * | 2/1996 | Ramo | E05B 21/066 70/366 |
| 2008/0289378 | A1 | 11/2008 | Yang | |
| 2012/0210758 | A1 | 8/2012 | Dolev et al. | |

FOREIGN PATENT DOCUMENTS

| | | | |
|---|---|---|---|
| EP | 0617184 | A2 | 9/1994 |
| EP | 1233127 | A1 | 8/2002 |
| FI | 81429 | | 10/1986 |
| FR | 2384923 | A1 | 10/1978 |
| GB | 2 173 852 | A | 10/1986 |

* cited by examiner

*Primary Examiner* — Suzanne Barrett
*Assistant Examiner* — Morgan McClure
(74) *Attorney, Agent, or Firm* — Muncy, Geissler, Olds & Lowe, P.C.

(57) ABSTRACT

The rotation limiter disc elements of a disc tumbler cylinder lock-key-combination are arranged to be rotated by a key. The rotation limiting elements have no pieces non-rotatably attached to the inner cylinder. The rotation limiter disc elements are composed of a frame piece and a limiter piece. The frame piece is a circular disc having an opening in the middle of the disc. The opening extends up to the border of the disc widening towards the border, and to the section on the wider side of the opening is disposed a limiter piece. On the inner surface of the inner cylinder is a recess at the site of the limiter disc elements. The key has at least one bevel-edged cavity.

14 Claims, 4 Drawing Sheets

DISC TUMBLER CYLINDER LOCK AND KEY COMBINATION

FIELD OF THE INVENTION

Figure 1:
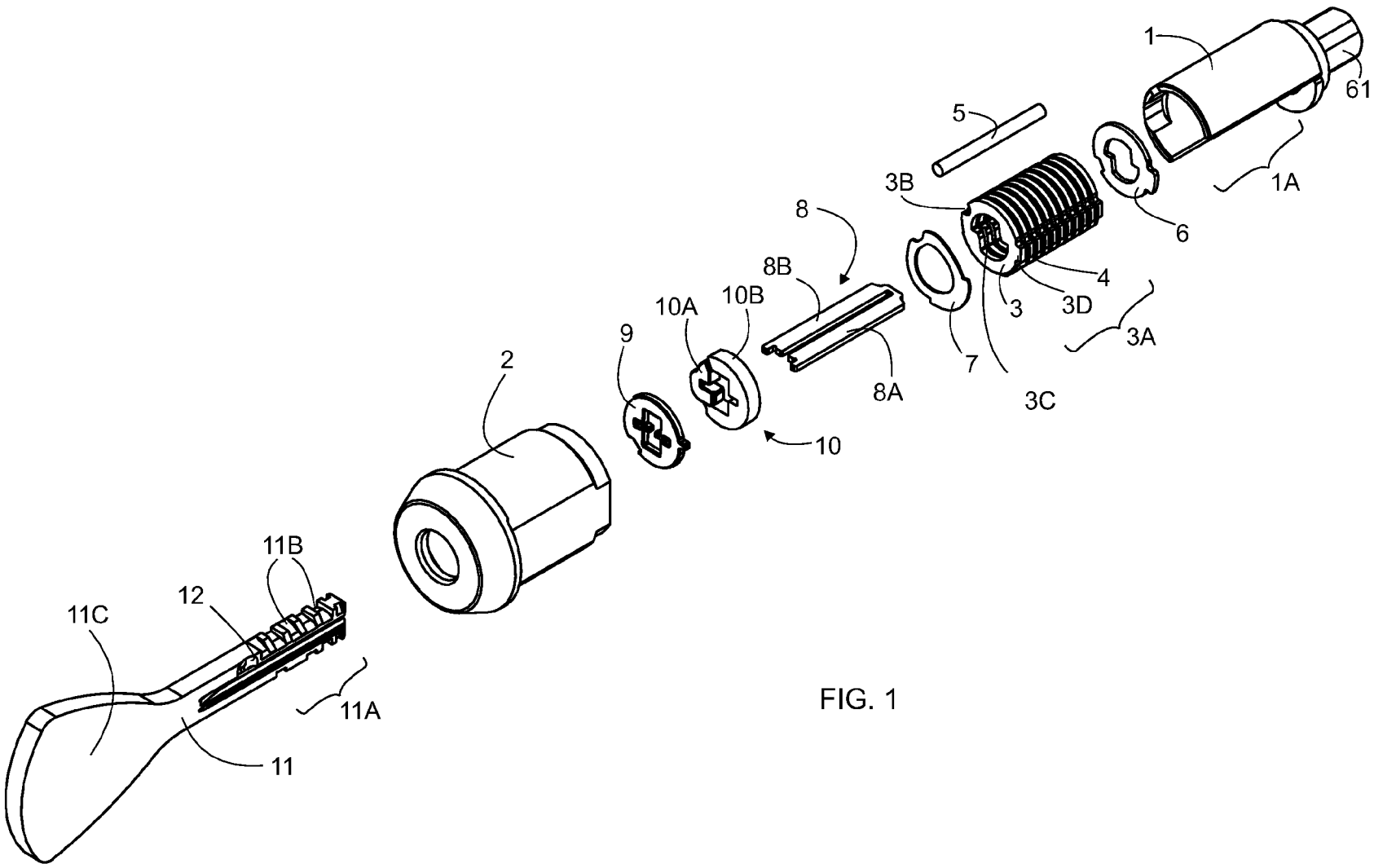

The invention relates to a disc tumbler cylinder lock and key combination, in which the tumbler discs of the cylinder lock are rotatable by a key.

PRIOR ART

In disc tumbler cylinder locks, rotatable tumbler discs are used to resolve a key-specific code and open the lock. Inserting a key into a disc tumbler cylinder lock does not yet cause the code to be resolved, rather it is the turning of the key that causes turning of the tumbler discs according to the millings of the key and thus resolution of the key code.

It has been observed that if a key is, for some reason, not fully inserted into a disc tumbler cylinder lock, then the turns of the key can, in this case, cause a very slight turning of the tumbler discs away from their common starting position. The starting position means that the key can be inserted into the cylinder lock. In the starting position, the lock (cylinder lock) is also in the locked position. If some of the tumbler discs have turned slightly from the starting position, then, in this case, inserting the key into the lock does not go smoothly, it will instead be experienced as difficult or impossible. The key will have to be turned several times from side to side in order to get the key fully into the cylinder lock. To prevent this, disc tumbler cylinder locks are often provided with a rotation limiter.

A rotation limiter is a mechanism, which prevents a key from turning in a disc tumbler cylinder lock, if the key is not fully inserted into the cylinder. The rotation limiter allows a key in a cylinder lock to be turned, when the key is fully inserted into the cylinder. Patent publication FI 81429 presents a known rotation limiter of a disc tumbler cylinder lock. The rotation limiter comprises an annular frame and two limiter parts. Both the frame and the limiter parts are disc-like. The frame is attached to the inner cylinder of the disc tumbler cylinder lock such that it is not able to rotate. The annular frame surrounds the limiter parts. The key has grooves on both sides of the key at the site of the rotation limiter. If the key is not fully inserted into the cylinder lock, then, if an attempt is made to turn the key, the surface of its shaft keeps the limiter parts against the recesses of the inner edge of the annular frame, wherein the key is not able to rotate. The limiter parts are able to move towards the key, when it is fully inserted into the cylinder lock and it is rotated. Then the limiter parts move partially into the grooves of the key and are released from the annular frame as the key is rotated. The key can thus be turned so that the tumbler discs can move into the correct position for opening the lock. Then, the inner cylinder is able to turn as the key is further turned. Patent publication FI 931349 presents a second rotation limiter having disc structures. Additionally, there exist rotation limiters with more complicated structures, such as balls and springs. The rotation limiter also prevents removal of the key from the lock cylinder other than in the starting position. The rotation limiter makes the disc tumbler cylinder lock more functionally reliable.

Into the key canal (the canal, into which the key is inserted) of a disc tumbler cylinder lock is also often disposed a guide element, which is composed of two rails, which settle against the sides of a key inserted into the cylinder lock. Also the guide element prevents mixing of the disc pack as well as wearing of the key, as it guides the key into the key canal in the desired position. The guide element is often connected to the rotation limiter.

Although known rotation limiters are suitable for wide use in disc tumbler cylinder locks, they, nonetheless, are not used in all types of cylinders. Current rotation limiters are fitted on a case-by-case basis to given types of cylinder types, for example, to a disc tumbler lock cylinder, in which the inner cylinder forms a uniform ring with the exception of a gap for the locking bar, or to a disc tumbler lock cylinder, in which the inner cylinder is sectioned from a given sector. Additionally, constraints are perceived in the production of a cylinder lock without a rotation limiter or as provided with a rotation limiter.

BRIEF DESCRIPTION OF THE INVENTION

The object of the invention is to reduce remove the problems of known art. The object is achieved in the manner described in the independent claim. The dependent claims describe various embodiments of the invention. In a solution according to the invention, rotation limiting means are arranged to be rotated by a key, wherein the rotation limiter parts have no pieces non-rotatably attached to the inner cylinder. The disc tumbler cylinder lock of a disc tumbler cylinder lock-key-combination according to the invention comprises limiter disc means 10, which are composed of a frame piece 10B and a limiter piece 10A. The frame piece 10B is a circular disc having an opening 53 in the middle of the disc. The opening extends up to the border 52 of the disc widening towards the border, and to the portion on the side of said border 52 is disposed a limiter piece 10A (FIGS. 2 and 3), and the other side 214B of the opening 53 forms a sliding surface, along which the limiter piece is able to slide as the key 11 is rotated from the locked position of the lock.

The limiter piece 10A comprises a first projection 212, a second projection 26 and a third projection 29. The third projection is towards the bottom 53A of the opening 53 of the frame piece, the second projection 26 is in the opposite direction as the third projection 29, and the first projection 212 is transversely away from the third 29 and second 26 projections. The border surface 27 of the second projection 26 is wider than the width of the gap 21 of the inner cylinder. Each edge side of the end 29E of the third projection 29 is bevelled 29A, 29B, 29D.

On the bottom 53A of the opening 53 of the frame piece is additionally a recess 211 for the second rail 8A of the guide element, and between the third and first projections of the limiter piece is a recess 28 for the second rail 8B of the guide element.

On the inner surface 62 of the inner cylinder 1 is a recess 25 at the site of the limiter disc means 10 for the second projection 26 of the limiter piece 10A. The key 11 has at least one bevel-edged cavity 12 for the end 29E of the third projection. The gradient of the bevelled edge 12A of the cavity corresponds to the gradient of the bevelled edge sides 29A, 29B, 29D of the third projection 29. The limiter piece 10A and the frame piece 10B are rotatable in relation to the inner cylinder 1 as the key is rotated, wherein the end 29E of the limiter piece slides into the cavity of the key, and the second projection 26 of the limiter piece moves away from the recess 25 of the inner cylinder.

LIST OF FIGURES

Figure 2:
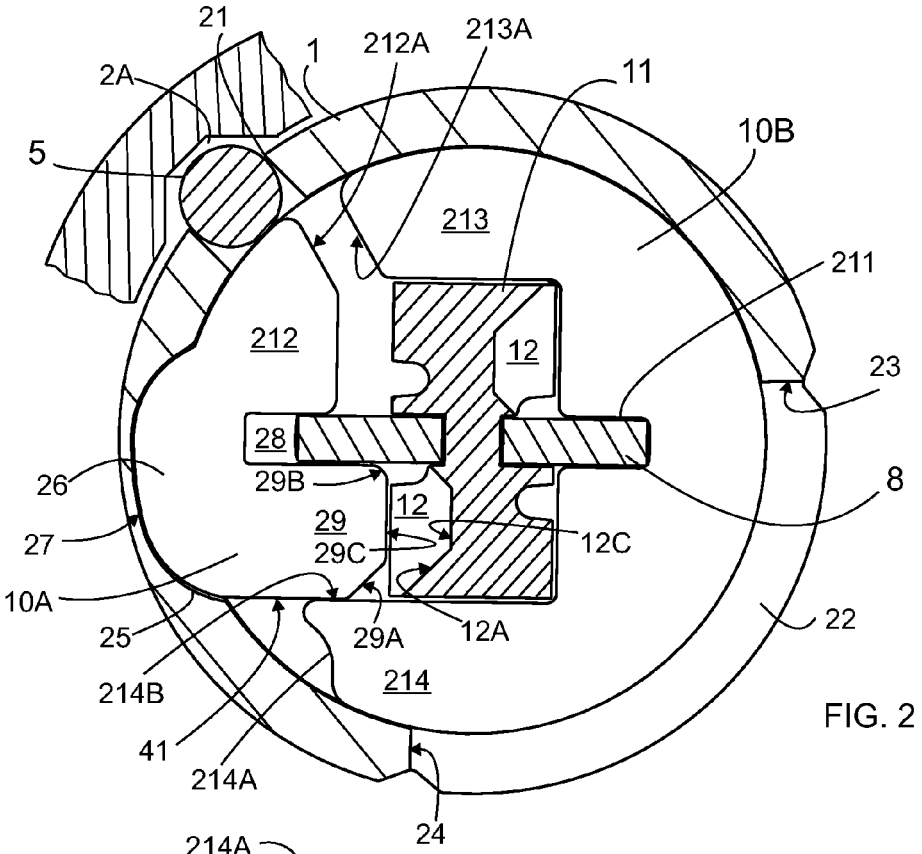
Figure 3:
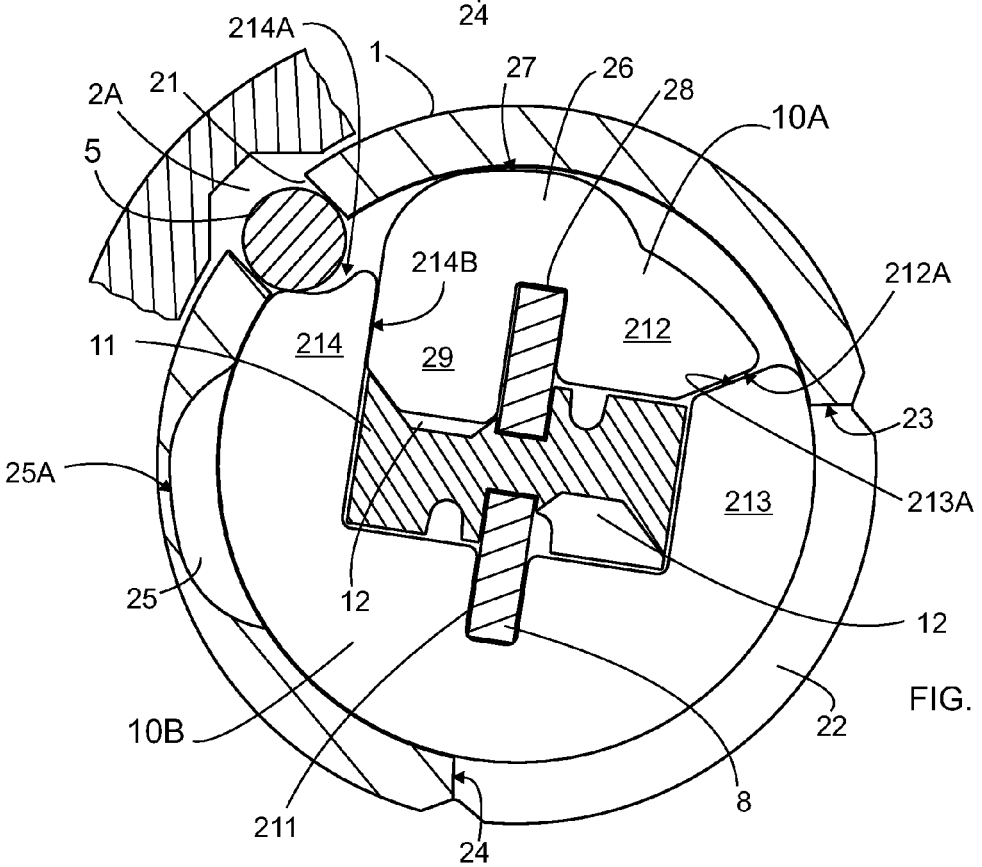
Figure 4:
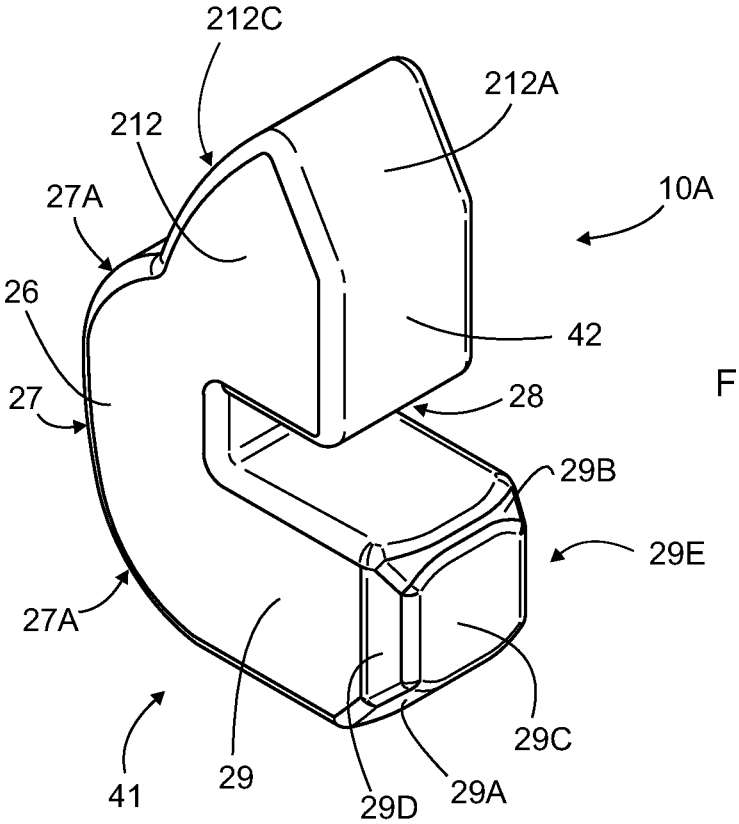
Figure 5:
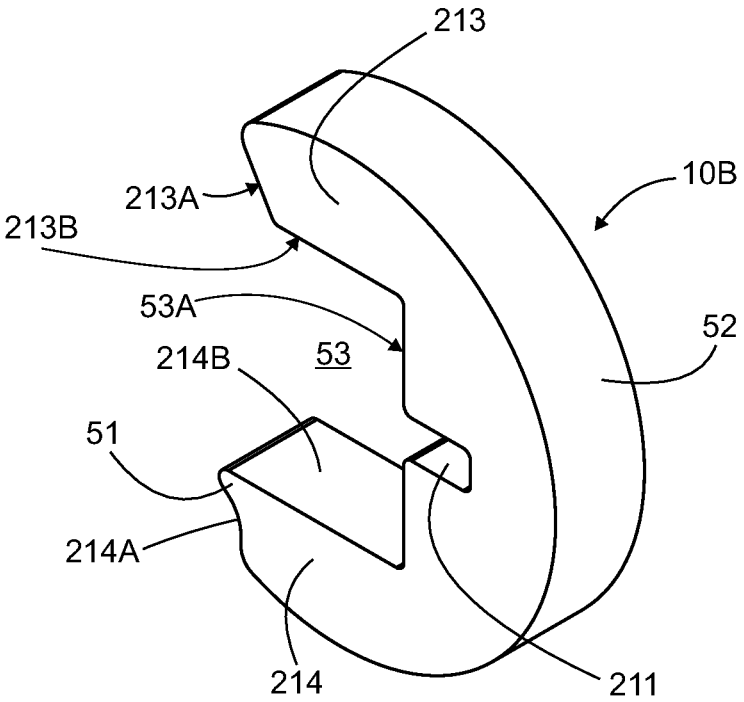
Figure 6:
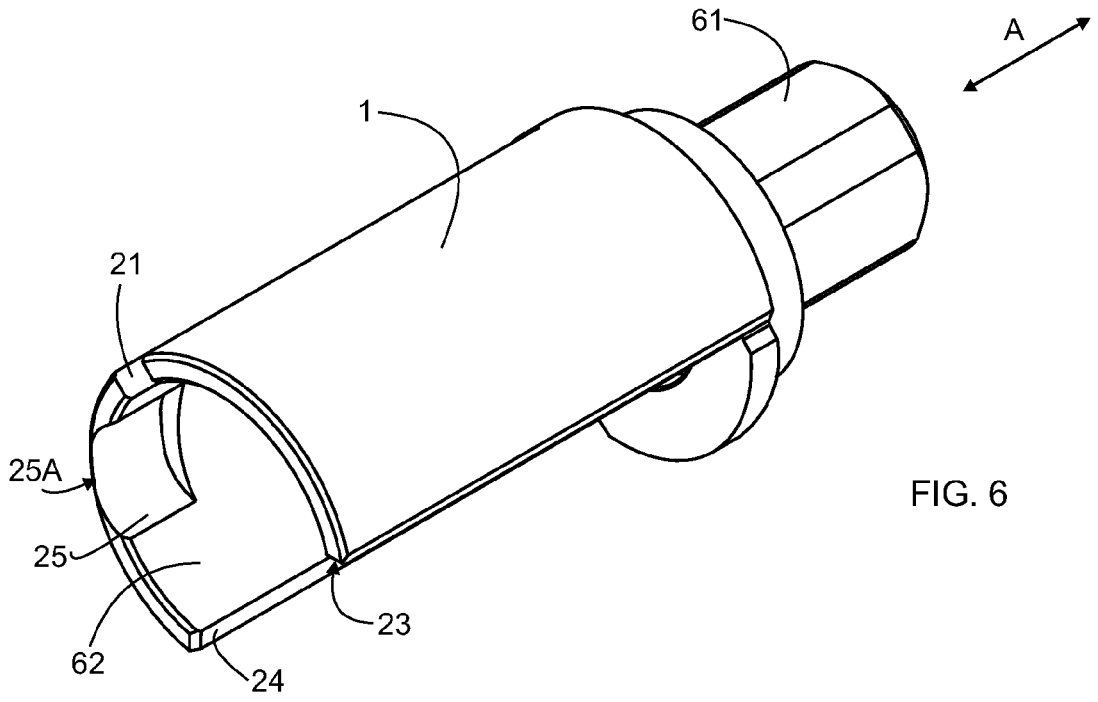
Figure 7:
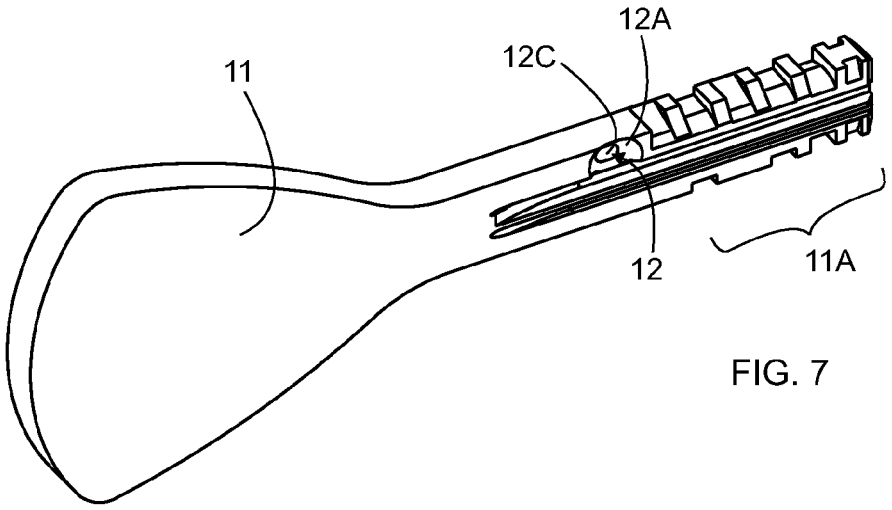

In the following, the invention is described in more detail by means of the figures of the accompanying drawings, in which FIG. 1 shows an example of a key and cylinder lock combination according to the invention with the parts of the cylinder separate, FIG. 2 shows a cross-section of the example of FIG. 1 with the key in the starting position at the site of the rotation limiting means, FIG. 3 shows a cross-section of the example of FIG. 1 with the key as rotated at the site of the rotation limiting means, FIG. 4 shows an example of a limiter piece of a rotation limiter means according to the invention, FIG. 5 shows an example of a frame piece of a rotation limiter means according to the invention, FIG. 6 shows an example of an inner cylinder according to the invention, and FIG. 7 shows an example of a key according to the invention.

DESCRIPTION OF THE INVENTION

FIG. 1 shows an example of a disc tumbler lock cylinder-key-combination according to the invention. In the figure, the parts of the cylinder are separate to illustrate the mutual placement of the parts in relation to each other. The disc tumbler cylinder lock of the combination comprises an outer cylinder 2 and an inner cylinder 1 to be rotated inside it. The inner cylinder comprises a casing portion 1A and a rear part 61. The rear part can be combined, for example, into the bolt means of the lock body. The outer cylinder can be combined, depending on the installation site, for example, into the door or other part. The structure of the outer cylinder also varies greatly due to the installation site.

The inner cylinder has a disc pack 3A, which comprises tumbler discs 3 provided with a central opening 30 and a peripheral cavity 3B, and spacer discs 4. The spacer discs separate the tumbler discs from each other. The central openings 3A of the tumbler discs and spacer discs form a uniform canal, i.e. the part of the key canal having the guide element 8. The guide element comprises two rails 8A, 8B. In this embodiment, the rails are connected to each other from the ends on the side of the bottom of the inner cylinder. The inner cylinder 1 further has rotation limiter disc means 10, which are in connection with the guide element 8, and a locking bar 5, which, when the lock is in the locked position, is located partially in the groove 2A in the outer cylinder 2 and partially in the gap 21 in the inner cylinder 1. The groove of the outer cylinder is shown in FIGS. 2 and 3. The tumbler discs 3 can be rotated by the key 11 of the combination into a position, in which the peripheral cavities 3B are at the site of the gap 21 of the inner cylinder forming a uniform groove, into which the locking bar 5 is able to move by the rotation of the key.

The limiter disc means 10 are composed of a frame piece 10B and a limiter piece 10A. FIGS. 4 and 5 show a frame piece and a limiter piece. The frame piece 10B is a circular disc having an opening 53 in the middle of the disc. The opening extends up to the border 52 of the disc widening towards the border. To the wider portion of the opening, on the side of said border 52, is disposed a limiter piece 10A, and at the bottom 53A of the opening 53 is additionally a recess 211 for the first rail 8A of the guide element. The first side 214B of the opening 53 forms a sliding surface, along which the limiter piece is able to slide as the key 11 is rotated from the locked position, i.e. from the starting position, of the lock.

The limiter piece 10A comprises a first projection 212, a second projection 26 and a third projection 29. The third projection is towards the bottom 53A of the opening 53 of the frame piece. The second projection 26 is in the opposite direction as the third projection 29. The first projection 212 is transversely away from the third 29 and second 26 projections. Between the third and first projections is a recess 28 for the second rail 8B of the guide element. The border surface 27 of the second projection 26 is wider than the width of the gap 21 of the inner cylinder. Each edge side of the end 29E of the third projection 29 is bevelled 29A, 29B, 29D, as is shown in FIG. 4.

On the inner surface 62 of the inner cylinder 1 is a recess 25 at the site of the limiter disc means 10 for the second projection 26 of the limiter piece 10A. When the lock is in the locked position (FIG. 2), the second projection of the limiter piece is in the recess 25. The key 11 has at least one bevel-edged cavity 12 for the end 29E of the third projection 29. The gradient of the bevelled edge 12A of the cavity corresponds to the gradient of the bevelled side edges 29A, 29B, 29D of the third projection 29. The limiter piece 10A and frame piece 10B can be rotated in relation to the inner cylinder 1 as the key is rotated. As the key is rotated, the limiter piece slides towards the key such that the end 29E of the third projection goes into the cavity 12 of the key, and the second projection 26 moves away from the recess 25 of the inner cylinder. Due to this, rotation of the key can continue, wherein also the limiter piece and the frame piece rotate along with the key (FIG. 3). Because the border surface 27 of the second projection 26 is wider than the width of the gap 21 of the inner cylinder, the second projection does not move into the gap 21, but instead is able to move over the gap.

From FIG. 1 is also seen the millings 11B of the shaft 11A of the key, which form the code of the key, using which the tumbler discs can be arranged to open the lock. The key is rotated from the leaf 11C of the key. Additionally, the lock cylinder may have a separate transmission disc 6 and a spring disc 7, which, as needed, assists in holding together the disc pack 3A.The shape of the spring disc of FIG. 1 corresponds to the shape of the spacer disc 4, but, additionally, it is slightly curved to create spring characteristics. Additionally, the inner cylinder can comprise a profile disc 9, the key opening profile of which corresponds to the profile of the key 11. The profile disc can, at the same time, also be a so-called rising zero tumbler disc, which is used to move the locking bar partially into the groove 21 of the outer cylinder, when the key is turned towards the starting position in order to lock the lock (lock cylinder).

In the embodiment of the example of FIG. 1, the casing 1A of the inner cylinder 1 comprises a section 22 on a given sector, and the tumbler discs 3 are provided with a peripheral projection 3D. The peripheral projections 3D are located inside the section limiting the rotation of the tumbler discs 3 in relation to the inner cylinder 1. Thus, the starting position of the lock cylinder and key is clearly to be observed, as the key cannot be turned in this position into another "wrong" direction. The sector formed by the border 52 of the frame piece 10B of the disc rotation limiting means 10 of the embodiment in FIG. 1 is larger than the sector formed by the section 22 of the inner cylinder. Due to this, the frame piece remains in the inner cylinder regardless of the position of the key 11. FIG. 6 shows more clearly the inner cylinder 1, and the section of its casing. The ends 23, 24 of the section limit the rotating of the tumbler discs in relation to the inner cylinder. The bottom 25A of the recess is planar corresponding to the shape of the border of the second projection 26 of the limiter piece. The direction of the axis of the cylinder is marked by the letter A.

In inner cylinder types without a section of the casing, so-called return bars are often used to limit the rotating of the tumbler discs in relation to the inner cylinder. Disc rotation limiting means according to the invention can be used also in inner cylinder types, as also in other inner cylinder types having a uniform casing (no section).

FIG. 2 shows a section of the example of FIG. 1 at the site of the rotation limiter, when the key is in the starting position and the cylinder lock is in the locked position. The second projection 26 of the limiter piece is in the recess 25 of the inner surface of the inner cylinder 1. FIG. 3 shows a situation, in which the key is rotated into such a position, in which the rotating of the key has moved the locking bar 5 away from the groove of the outer cylinder into the uniform groove formed by the tumbler discs, spacer discs and possible other discs in the inner cylinder. Also the frame piece 10B of the rotation limiting means, shown in FIG. 3, comprises a locking bar recess 214A on the side of the border 52 of the frame piece, into which the locking bar is able to partially move.

FIGS. 4 and 5 show a frame piece 10B and a limiter piece 10A. On the side of the first side 214B of the opening 53 of the frame piece is a first projection 214 of the frame piece and on the side of the other side 213B a second projection 213 of the frame piece. At the end 51 of the first projection 214 is above said locking bar recess 214A on the side of the border 52 of the frame piece.

The side 41 on the side of the border of the third projection 29 of the limiter piece 10A is a counter sliding surface against the sliding surface formed by the first side 214B of the opening 53 of the frame piece 10B. The side 212C on the border side of the first projection 212 of the limiter piece 10A is a curved support surface against the inner surface 62 of the inner cylinder 1. The ends 27A of the border of the second projection 26 can be shaped as curved in the manner shown in the figures, wherein the second projection moves smoothly over the gap 21 of the inner cylinder as the key is rotated. Thus, the second projection does not then become tangled in the groove 21. The surface 42 on the side of the opening 53 of the frame piece of the first projection 212 comprises a canal surface towards the bottom 53A of the opening. This surface is against the side of the key as the key is rotated, as is shown in FIG. 3. Additionally, the surface on the side of the opening 53 of the frame piece of the first projection 212 of the limiter piece can comprise a bevelled surface 212A. If in the end of the second projection 213 of the frame piece is a corresponding bevelled surface 213A, it is practical to arrange it towards the bevelled surface. If dimensioning of the frame piece and limiter piece is precise, the bevelled surface and the corresponding bevelled surface contact each other as the key is rotated, wherein the corresponding surface forms an additional support surface to the limiter piece. The edges of the sides of the limiter piece 10A can also be rounded, as is shown in FIG. 4.

The profiles of the recesses 211, 28 of the frame piece 10A and the limiter piece 10B correspond to the profiles of the rails 8A, 8B of the guide element. From FIGS. 2 and 3 is seen, how the rails settle in the recesses 211, 28 of the frame piece and the limiter piece and support them. The profiles of the rails can be different. As can be observed from the example of FIG. 1, the thickness of the frame piece- and limiter piece discs 10B, 10A can be greater than the thickness of an individual tumbler disc 3. Thus, it is possible to achieve additional solidity, durability and functional reliability in the functioning of the rotation limiter means.

Especially in such an embodiment, in which are used rotation limiting means 10 thicker than the tumbler discs, the cavity of the key 11 is longer in the direction of the shaft 11A of the key than in relation to the shaft of the key in the transverse direction.

The bottom 12C of the cavity of the key 11 and the surface 29C of the end of the third projection 29 can be planar. If the depth of the cavity of the key 11 is greater than the reach of the third projection 29 into the cavity 12 of the key, the end 29E of the third projection does not contact the bottom of the cavity, instead contact is on the bevelled edge of the cavity. To the bottom of the cavity can thus remain space in the manner shown in FIG. 3, which also partially creates functional reliability, because dirt that may have collected to the bottom of the cavity hence does not hinder the cooperative functioning of the key and the limiter piece. The gradient angle of the edges 12A of the cavity of the key 11 and the bevelled side edges 29A, 29B, 29D of the third projection 29 is, for example, 45 degrees or approximately 45 degrees.

FIG. 7 shows a key 11 of a disc tumbler cylinder lock-key-combination, from a viewing angle, from which is clearly seen the cavity 12 and its bevelled edge 12A. In the example of the figure, the cavity is oblong in the direction of the shaft of the key forming an oval. The bevelled edge transmits the force rotating the key to the bevelled side edges of the end of the third projection 29 of the limiter piece, as can be observed from FIG. 3. When the gradient angle of the bevelled edge and bevelled side edges is the same or at least close to each other, wearing of the cavity of the key and the third projection of the limiter piece can be decreased. Wearing occurs not only in connection with the rotation of the key but also as the key is pulled out from the lock cylinder, wherein the bevelled edge of the cavity 12 of the key pushes the limiter piece towards the inner cylinder 1 such that the second projection 26 of the limiter piece moves into the recess 25 of the inner surface of the inner cylinder. In known disc rotation limiters, the side edges of the limiter parts and the edges of the cavities wear a relatively great deal.

Wearing of the end of the shaft of the key and the limiter piece can also occur as the key is inserted, if the limiter piece 10A has been able to move slightly, for example, due to exterior vibration. When wearing is less, the cooperative functioning of the limiter piece and the key remains more functionally reliable for a longer period of time. If the depth of the cavity 12 is such that the end 29E of the third projection of the limiter piece forms a contact with the bottom 12C of the cavity, it and the end of the projection also participate in transmitting forces between the key and the limiter piece. If the key is not produced as symmetric (i.e. the key cannot be inserted into the lock cylinder also upside down thus changing its position 180 degrees), one cavity 12 is adequate. In symmetric solutions, such as in the example of the figures, there are two cavities.

As was said above, a two-part disc rotation limiter is suitable for use also in inner cylinders without a section of the casing for the tumbler discs. A two-part disc rotation limiter is also excellently suited for the production of different lock cylinder versions. If a rotation limiter is not needed due to the requirements of the usage site, it does not need to be placed in the inner cylinder, instead it can be replaced, for example, with tumbler discs and spacer discs. The thickness of the limiter piece and the frame piece is thus practical to select such that it corresponds to the sum thickness of a given number of tumbler discs and spacer discs, for example, the thickness of two tumbler discs and two spacer discs. Thus, it is possible to conveniently produce disc tumbler cylinder locks provided with or without a disc rotation limiter. Additionally, producing a two-part disc rotation limiter is less expensive in that fewer parts are needed than in known solutions. As was already stated earlier, in known solutions, into the inner cylinder is connected an annular frame such that it is not able to turn in relation to the inner cylinder.

In light of the examples presented above, it is obvious that the embodiment according to the invention can be provided by many different solutions. The shapes of the frame piece and the limiter piece can be different than is presented in the figures in this connection, as the implementation of the cylinder may affect the shape of the parts. It is obvious that the invention is not limited only to examples mentioned in this text, rather it can be implemented by many various embodiments within the scope of the independent claim.

The invention claimed is:

1. A disc tumbler cylinder lock-key-combination, the disc tumbler cylinder-lock of which combination comprises an outer cylinder and to be rotated inside the outer cylinder, an inner cylinder having a disc pack, which comprises tumbler discs provided with a central opening and a peripheral cavity, and spacer discs, which spacer discs separate the tumbler discs from each other, and central openings form a uniform canal having a guide element, which comprises two rails, which inner cylinder further has rotation limiter disc means, which are in connection with the guide element, and a locking bar, which, when the lock is in a locked position, is located partially in the groove in the outer cylinder and partially in a gap in the inner cylinder, which tumbler discs are rotatable by a key of the combination into a position, in which the peripheral cavities are at the site of the gap of the inner cylinder forming a uniform groove, into which the locking bar is able to move by the rotation of the key, wherein the limiter disc means are composed of a frame piece and a limiter piece, which frame piece is an annular disc having an opening in the middle of the disc, which opening extends up to a border of the disc widening towards the border and to the wider portion of the opening, on a side of said border, is disposed a limiter piece, and on a bottom of which opening is additionally a recess for the first rail of the guide element, and the first side of the opening forming a sliding surface, along which the limiter piece is able to slide as the key is rotated from the locked position of the lock, which limiter piece comprises a first projection, a second projection and a third projection, the third projection being towards the bottom of the opening of the frame piece, the second projection being in an opposite direction as the third projection, and the first projection being transversely away from the third and second projections, between which third and first projections is a recess for the second rail of the guide element, a border surface of the second projection being wider than a width of the gap of the inner cylinder and each side edge of an end of the third projection being bevelled, on an inner surface of which inner cylinder is a recess at the site of the rotation limiter disc means for the second projection of the limiter piece, and which key has at least one bevel-edged cavity for the end of the third projection, a gradient of the bevelled edge corresponding to a gradient of the bevelled side edges of the third projection, the limiter piece and frame piece being rotatable in relation to the inner cylinder as the key is rotated.

2. The disc tumbler cylinder lock-key-combination according to claim 1, wherein the tumbler discs are provided with a peripheral projection and the inner cylinder has a section on a given sector, in which section the peripheral projections are located limiting the rotation of the tumbler discs in relation to the inner cylinder, the sector formed by the border of the frame piece being larger than the sector formed by the section such that the frame piece remains in the inner cylinder regardless of the position of the key.

3. The disc tumbler cylinder lock-key-combination according to claim 1 wherein on a side of the first side of the opening is the first projection of the frame piece and on a side of an other side of the opening is the second projection of the frame piece, in an end of which first projection is a locking bar recess on the side of the border of the frame piece.

4. The disc tumbler cylinder lock-key-combination according to claim 3, wherein the third projection of the limiter piece, a side on the side of the border is a counter sliding surface against the sliding surface formed by the first side of the opening of the frame piece, and a side of the first projection of the limiter piece on the side of the border is a curved support surface against the inner surface of the inner cylinder.

5. The disc tumbler cylinder lock-key-combination according to claim 4, wherein ends of the border surface of the second projection are curved.

6. disc tumbler cylinder lock-key-combination according to claim 5, wherein a thickness of the frame piece and limiter piece discs is greater than a thickness of an individual tumbler disc.

7. The disc tumbler cylinder lock-key-combination according to claim 6, wherein a cavity of the key is longer in the direction of the shaft of the key than in relation to a shaft of the key in a transverse direction.

8. The disc tumbler cylinder lock-key-combination according to claim 7, wherein a surface of the first projection on the side of the opening of the frame piece comprises a canal surface towards the bottom of the opening.

9. The disc tumbler cylinder lock-key-combination according to claim 8, wherein a surface of the first projection of the limiter piece on the side of the opening of the frame piece further comprises a first beveled surface and an end of the second projection of the frame piece comprises a correspondingly second beveled surface such that it faces towards the first beveled surface.

10. The disc tumbler cylinder lock-key-combination according to claim 9, wherein the edges of the sides of the limiter piece are rounded.

11. The disc tumbler cylinder lock-key-combination according to claim 10, wherein profiles of the recesses of the frame piece and the limiter piece correspond to profiles of the rails of the guide element.

12. The disc tumbler cylinder lock-key-combination according to claim 1, wherein a bottom of the cavity of the key and a surface of the end of the third projection are planar.

13. The disc tumbler cylinder lock-key-combination according to claim 12, wherein a depth of the cavity of the key is greater than a reach of the third projection into the cavity of the key.

14. The disc tumbler cylinder lock-key-combination according to claim 13, wherein a gradient angle of the edges of the cavity of the key and of the bevelled side edges of the third projection is 45 degrees or approximately 45 degrees.

* * * * *